United States Patent [19]

Brettschneider et al.

[11] 4,007,719

[45] Feb. 15, 1977

[54] APPARATUS FOR THE DETOXIFICATION OF EXHAUST GASES

[75] Inventors: Johannes Brettschneider, Ludwigsburg-Pflugfelden; Lorenz Bundesen, Flensburg; Heinrich Knapp, Leonberg-Silberberg, all of Germany

[73] Assignee: Robert Bosch G.m.b.H., Stuttgart, Germany

[22] Filed: Dec. 30, 1975

[21] Appl. No.: 645,385

Related U.S. Application Data

[63] Continuation of Ser. No. 476,231, June 4, 1974, abandoned.

[30] Foreign Application Priority Data

June 29, 1973 Germany ..... 2333082
Oct. 3, 1973 Germany ..... 2349559

[52] U.S. Cl. ..... 123/119 D; 123/124 R; 60/285

[51] Int. Cl.[2] ..... F02M 7/00

[56] References Cited

UNITED STATES PATENTS

| | | | |
|---|---|---|---|
| 3,294,074 | 12/1966 | Mennicken et al. | 123/119 D |
| 3,759,232 | 9/1973 | Wahl et al. | 60/276 |
| 3,788,070 | 1/1974 | Camarasa et al. | 60/290 |
| 3,799,301 | 3/1974 | Bentley | 123/124 R |
| 3,827,237 | 8/1974 | Linder et al. | 123/32 EA |

*Primary Examiner*—Charles J. Myhre
*Assistant Examiner*—James D. Liles
*Attorney, Agent, or Firm*—Edwin E. Greigg

[57] ABSTRACT

An apparatus for the detoxification of exhaust gases of an internal combustion engine having a fuel metering mechanism, such as a carburetor, which meters out fuel corresponding to the air quantity, is described. An air quantity measuring device is provided which controls the metering mechanism so as to achieve a slightly enriched fuel-air mixture. Thus, the air number (λ) is initially maintained at less than 1, the air number 1 designating a stoichiometric fuel-air mixture. Secondary air is admitted via a secondary air pump, an oxygen sensor being disposed on the exhaust side, until such time an optimum of fuel-air mixture is reached. The secondary air is admitted into the suction tube of the internal combustion engine downstream of the air measuring device.

17 Claims, 4 Drawing Figures

APPARATUS FOR THE DETOXIFICATION OF EXHAUST GASES

This is a continuation, of application Ser. No. 476,231, filed June 4, 1974, abandoned.

BACKGROUND OF THE INVENTION

This invention relates to an apparatus for the detoxification of exhaust gases in an internal combustion engine. The invention relates, more particularly, to an apparatus for the detoxification of the exhaust gases of an internal combustion engine provided with a fuel metering mechanism, especially a carburetor, which meters fuel corresponding to the air quantity, as measured by an air quantity measuring device, so as to achieve a slightly enriched fuel air mixture (air number $\lambda < 1$). The apparatus includes a secondary air pump, by means of which secondary air is admitted under the control of an oxygen sensor disposed within the exhaust system, and until such time as an optimum fuel-air mixture is reached, corresponding to a particular air number $\lambda$.

It has already been suggested to admit secondary air ahead of a catalyzer into the exhaust gases of the internal combustion engine and to control the amount of secondary air by means of an oxygen sensor exposed to the exhaust gases. From a point of view of automatic control practice, this solution has the advantage that the regulation lag time is relatively short, because the actual and nominal values are both measured and determined within the exhaust system. On the primary side of the internal combustion engine, only a slightly enriched setting of the fuel-air mixture is necessary which does not make great demands on control processes. However, this known technique has the disadvantage that the fuel consumption is relatively high which can have a major importance in the future due to the increasing fuel prices and because of the decrease of raw material reserves. The relatively long dead time, which occurs in arrangements in which the measurement of the actual value is done on the secondary side of the engine and the setting of the nominal value is done on the primary side, is disadvantageous only under small loads and at low rpms.

SUMMARY OF THE INVENTION

It is an object of the present invention to provide an apparatus for the detoxification of the exhaust gases of an internal combustion engine which avoids disadvantageous dead time, especially under small loads.

It is another object of the present invention to provide an apparatus for the detoxification of exhaust gases of an internal combustion engine which avoids high fuel consumption.

It is an additional object of the present invention to provide an apparatus for the detoxification of exhaust gases which avoids disadvantageous dead time, especially at low rpms.

The foregoing objects, as well as others which are to become clear from the text below, are achieved in accordance with the present invention in an apparatus for the detoxification of exhaust gases of an internal combustion engine having a fuel metering mechanism which meters out fuel corresponding to air quantity, as measured by an air quantity measuring device. As a result, a slightly enriched fuel-air mixture is achieved. A secondary air pump, controlled by an oxygen sensor disposed on the exhaust gas side, is provided for admitting secondary air, an optimum air number $\lambda$ being reached. The secondary air is admitted to the suction tube of the internal combustion engine downstream from the air quantity measuring device.

The salient novel feature of the present invention is that means are provided for admitting the secondary air to the suction tube of the internal combustion engine downstream of the air measuring device.

Thus, the entire injected fuel quantity, which produces a favorable thermal efficiency, is combusted. The effect of the sensor is that by admitting the secondary air just ahead of the internal combustion engine, a stoichiometric fuel air mixture, corresponding to an air number ($\lambda$) equal to 1 is produced and, as is well known, this has the effect that the uncombusted quantities of hydrocarbons and of carbon monoxide are very low. The nitrogen oxide products which are especially prevalent under these conditions are reduced in a subsequent catalyzer, if necessary.

According to an advantageous embodiment of the invention, the secondary air line includes a solenoid valve, which is controlled by the oxygen sensor via an amplifier, and which operates either cyclically or in analog fashion.

According to a supplementary embodiment of the invention, there is also disposed in the secondary air line a differential pressure control valve by means of which the pressure of the secondary air is kept higher by a predetermined and changeable amount than the absolute pressure prevailing in the suction tube ahead of the secondary air line termination. Appropriate mechanisms can be present by means of which this pressure can have an additive or multiplicative relationship to the pressure in the suction tube. It is a matter of experience that this injection pressure should be from about 50 to about 100% more than the absolute suction tube pressure.

An exemplary embodiment of the present invention is shown, in simplified form, in the accompanying drawing figures and is described below.

DESCRIPTION OF THE PREFERRED EMBODIMENT AND VARIANTS

Figure 1:
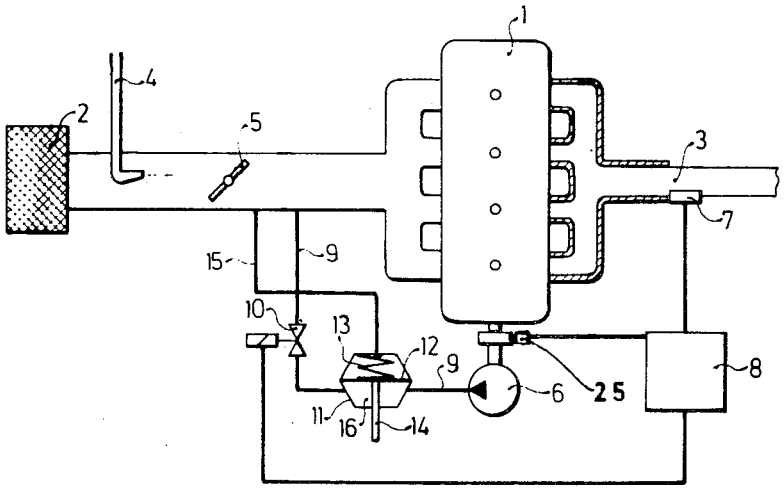
FIG. 1 is a partially schematic illustration of an apparatus for the detoxification of exhaust gases which includes a pressure control valve according to the present invention.

As shown in FIG. 1, an internal combustion engine 1 aspirates air through a suction tube 2, and expels exhaust gas through an exhaust system generally designated by the numeral 3. Disposed in suction tube 2 is a carburetor 4 and an arbitrarily actuatable throttle flap 5 by means of which the air quantity aspirated by the engine can be altered. Depending on the air quantity aspirated, the carburetor 4 meters out an appropriate amount of fuel and the mixture ratio of fuel to air quantities is kept slightly "rich," i.e. with respect to a stoichiometric mixture, more fuel being metered out. The stoichiometric air-fuel mixture is defined by the relation $\lambda = 1.0$ where $\lambda$ is designated as the air number. For air numbers ($\lambda$) which are greater than 1, the internal combustion engine 1 thus receives a lean mixture and for air numbers ($\lambda$) which are less than 1, as in the present case, the engine 1 receives a rich mixture.

In order to achieve a fuel-air mixture which produces complete combustion and hence, as desired, an exhaust free of noxious substances, an air pump 6 driven by the internal combustion engine 1 blows secondary air into the suction tube 2 until such a time as the relation $\lambda = 1$ is satisfied. The actual value of the fuel-air mixture is monitored by an oxygen sensor 7 disposed in the exhaust system 3 whose output voltage jumps whenever the stoichiometric mixture is reached. This output voltage is used in a control instrument having a control device 8, which may be an amplifier, for the purpose of regulating a solenoid valve 10 disposed in a secondary air line 9. This solenoid valve 10 can operate either cyclically or in analog fashion. When it is cyclically actuated, the control current is chopped in the control device 8, or it is merely amplified; in an analog control process, the control current is integrated. In order to adapt the pressure of the secondary airstream to the pressure in the suction tube 2, a differential pressure valve 11 is disposed in the secondary air line 9 in addition to the magnetic valve 10. In the embodiment shown in FIG. 1, a membrane 12 loaded by a spring 13 conrtrols a relief line 14. The end of the relief line 14 serves as a fixed valve seat and the membrane 12 as the movable valve member. The space containing this spring 13 and defined by the membrane 12, is connected through a line 15 with the suction tube 2 at a point upstream of the termination of the secondary air line 9. Another and separate chamber 16 of the differential pressure valve 11 is merely traversed by the secondary air. The valve 11 has the effect that the secondary pressure is always higher than the absolute pressure in the suction tube 2 by a predetermined amount. Thus a constant excess pressure is realized which produces an additive influence of the signal from the sensor 7.

Figure 2:
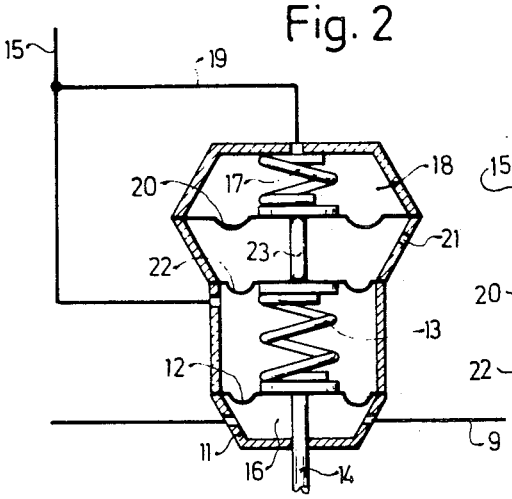
FIG. 2 is a cross-sectional view of the differential pressure control valve of the apparatus of FIG. 1 arranged for a multiplicative adaptation.

FIG. 2 shows a differential pressure valve 11 by means of which a multiplicative influence of the sensor signal can be achieved. This is done in that, during times of increasing load, the difference between the suction tube pressure and the secondary air pressure also increases. This change of the pressure difference at the valve 11 is achieved in that, associated with the previously described differential pressure control valve 11 (FIG. 1), there is a setting spring 17 whose pretension changes with the path traversed. The spring 17 is also disposed in a pressure chamber 18, formed in part by a membrane 20, connected with the control line 15 via a line 19. The other side of the membrane 20 of the pressure chamber 18 is subject to atmospheric pressure produced by a relief bore 21 in a chamber formed between the membrane 20 and a membrane 22. Disposed between the membrane 20 and the membrane 22, loaded by a spring 13, is a strut 23 which produces a positive connection between the membranes 22 and 20 and hence also between the springs 13 and 17.

A multiplicative influence of this kind is required because the regulated air quantity metered out must be adapted to the air quantity flowing through the internal combustion engine 1 which is not a linear function but is a quadratic function of the suction tube pressure.

Other possibilities of adaptation include, according to the present invention, in that another parameter affecting the regulation can be the engine rpm and/or a variation in the characteristics of the differential pressure valve.

Figure 4:
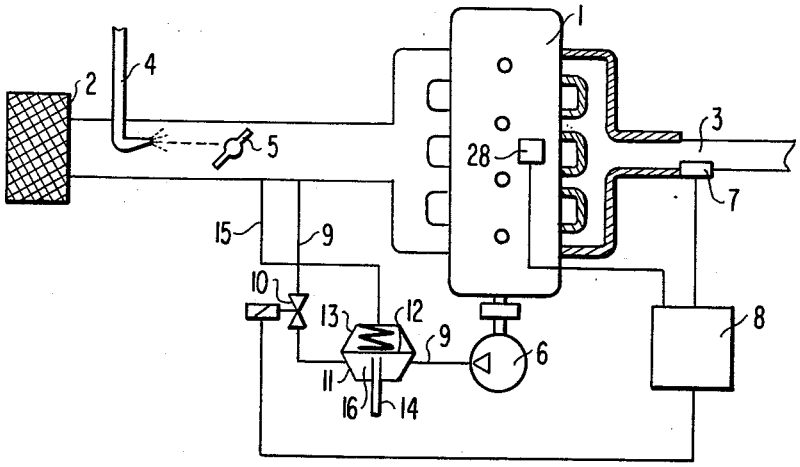
FIG. 4 illustrates the apparatus for the detoxification of exhaust gases including a pressure control valve and an ignition distributor take-off.

The take-off from the engine rpm is measured either by the ignition distributor 28 (FIG. 4) or, as shown in FIG. 1, by an instrument 25. The signal produced in either case is fed to the control device 8 so that the solenoid valve 10 is cyclically actuated at a frequency which is proportional to the engine rpm (ignition frequency) and wherein the opening time of the solenoid valve 10 depends on the voltage produced by the oxygen sensor 7. By cycling in proportion to the engine rpm, the secondary air quantity is adapted to the air quantity aspirated by the engine, so that only a simple air number ($\lambda$) correction occurs when the opening time is dependent on the voltage from the oxygen sensor 7. Since, in this case, the sensor voltage does not directly control the valve 10, the sensor output voltage can be integrated to equalize the mean deviations of the value of air number ($\lambda$) as among the individual cylinders; this also reduces erroneous peaks in the regulation of the air number ($\lambda$).

The solenoid valve 10 can be normally closed, in which case the adaptation is achieved by admitting the secondary air flow or it can be normally open in which case the secondary air supply is throttled or interrupted, as required. In the first case, the control process starts with a mixture which is too rich and acts in the direction of leaning it out; in the second case, the opposite takes place.

Figure 3:
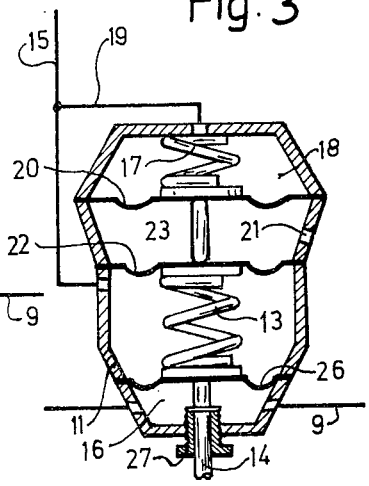
FIG. 3 is a cross-sectional view of a variant of a valve of FIG. 2.

FIG. 3 shows a variant of a differential pressure valve 11 in which a membrane 26, which directly controls the relief line 14, has a smaller effective diameter than have the membranes 20 and 22. A prior adjustment of the pretension of the spring 13 can be made by a hollow screw 27 disposed in the valve housing. The place of hollow screws 27 can also, as is not further shown, be taken by a setting magnet, controlled by the oxygen sensor 7, whereby the difference between the suction tube air pressure and the secondary air pressure is controllable in dependence on the voltage of the oxygen sensor 7.

It is to be appreciated that the foregoing description, as well as the accompanying drawing, relate to an illustrative embodiment and variants set out by way of example, not by way of limitation. Numerous other embodiments and variants are possible within the spirit and scope of the invention, the scope being defined by the appended claims.

What is claimed is:

1. In an apparatus for the detoxification of exhaust gases of an internal combustion engine having (a) a suction tube for air intake to the engine, (b) an air quantity measuring device disposed in said suction tube, (c) fuel metering means for metering out fuel corresponding to the air quantity measured by said air quantity measuring device so as to achieve slightly enriched fuel-air mixture, (d) an exhaust system for the exhaust gases of the engine, and (e) an oxygen sensing means disposed in said exhaust system, the improvement comprising: (f) a secondary pump, (g) means including a secondary air line connected between said secondary air pump and an inlet to said suction tube downstream of said air quantity measuring device, and (h) means connected to and controlled by said oxygen sensing means and connected to said means including said secondary air line for controlling the admission of secondary air from the secondary air pump to the suction tube through said secondary air line, until such time as an optimum value of air number is reached, wherein said means for controlling the admission of secondary air includes:

i. a magnetic valve means disposed within said secondary air line; and ii. a control device electrically disposed between said magnetic valve means and said oxygen sensing means for amplifying the output voltage of said oxygen sensing means and cyclically controlling said magnetic valve means proportionally to said amplified output voltage, wherein the opening point of said magnetic valve means is cyclically controlled by said control device at a frequency proportional to the engine rpm, in dependence on a signal fed to said control device by an engine rpm measuring means, and wherein the duration of opening of said magnetic valve means is controlled by said control device in dependence on the output voltage of said oxygen sensing means.

2. An apparatus according to claim 1, wherein the motor rpm measuring means is an ignition distributor.

3. In an apparatus for the detoxification of exhaust gases of an internal combustion engine having (a) a suction tube for air intake to the engine, (b) an air quantity measuring device disposed in said suction tube, (c) fuel metering means for metering out fuel corresponding to the air quantity measured by said air quantity measuring device so as to achieve a slightly enriched fuel-air mixture, (d) an exhaust system for the exhaust gases of the engine, and (e) an oxygen sensing means disposed in said exhaust system, the improvement comprising: (f) a secondary pump, (g) means including a secondary air line connected between said secondary air pump and an inlet to said suction tube downstream of said air quantity measuring device, (h) means connected to and controlled by said oxygen sensing means and connected to said means including said secondary air line for controlling the admission of secondary air from the secondary air pump to the suction tube through said secondary air line, until such time as an optimum value of air number is reached, and (i) a differential pressure control valve means disposed within said secondary air line so that the connections of the secondary air line to the differential pressure control valve means are unobstructed, said differential pressure control valve means serving to maintain pressure of secondary air higher than absolute pressure prevailing in said suction tube ahead of the secondary air inlet by a predetermined, changeable amount.

4. An apparatus according to claim 3, wherein said differential pressure control valve means includes a control membrane whose one side experiences secondary air pressure and whose other side experiences suction tube pressure.

5. An apparatus according to claim 4, including a normally fixed valve seat formed by an end of a relief line, and wherein said membrane controls said valve seat.

6. An apparatus according to claim 4, including a first spring and at least one second spring, and wherein said differential pressure valve means causes a multiplicative increase of secondary air as a function of load and rpm of the internal combustion engine, said valve means including said at least one second spring whose pretension is changeable by means of said separate membrane actuated by suction tube pressure and thus changing the pretension of said first spring.

7. An apparatus according to claim 3, wherein said differential pressure control valve means includes at least two operating membranes of different effective surface areas which positively cooperate with spring means.

8. An apparatus according to claim 7, including a screw, and wherein pretension of said spring means is changeable by means of said screw.

9. An apparatus according to claim 8, wherein said screw is a screw surrounding a relief line.

10. An apparatus according to claim 11, wherein said fuel metering means comprises a carburetor.

11. In an apparatus for the detoxification of exhaust gases of an internal combustion engine having (a) a suction tube for air intake to the engine, (b) an air quantity measuring device disposed in said suction tube, (c) fuel metering means for metering out fuel corresponding to the air quantity measured by said air quantity measuring device so as to achieve a slightly enriched fuel-air mixture, (d) an exhaust system for the exhaust gases of the engine, and (e) an oxygen sensing means disposed in said exhaust system, the improvement comprising: (f) a secondary air pump, (g) means including a secondary air line connected between said secondary air pump and an inlet to said suction tube downstream of said air quantity measuring device, (h) means connected to and controlled by said oxygen sensing means and connected to said means including said secondary air line for controlling the admission of secondary air from the secondary air pump to the suction tube through said secondary air line, continuously until such time as an optimum value of air number is reached.

12. An apparatus according to claim 11, wherein said means connected to said means including said secondary air line for controlling the admission of secondary air from the secondary air pump to the suction tube through said secondary air line includes magnetic valve means disposed within said secondary air line and a control device electrically disposed between said magnetic valve means and said oxygen sensing means for amplifying the output voltage of said oxygen sensing and controlling said magnetic valve means proportionally to said amplifier output voltage.

13. An apparatus according to claim 12, wherein said valve means operates in analog fashion.

14. An apparatus according to claim 12, wherein said valve means operates cyclically.

15. An apparatus according to claim 12, wherein said magnetic valve means is normally closed and can be controlled in the direction of opening (leaning out) so as to achieve the optimum value of air number (stoichiometric mixture).

16. An apparatus according to claim 12, wherein said magnetic valve means is normally open and is controllable in the direction of closing (an interruption of leaning out) for the purposes of achieving an optimum value of air number.

17. An apparatus according to claim 15, wherein the duration of opening of said magnetic valve means is affected by the rpm of the internal combustion engine.

* * * * *